US011651949B2

(12) United States Patent
Leibrandt et al.

(10) Patent No.: US 11,651,949 B2
(45) Date of Patent: May 16, 2023

(54) SPHERICAL ION TRAP AND TRAPPING IONS

(71) Applicant: Government of the United States of America, as represented by the Secretary of Commerce, Gaithersburg, MD (US)

(72) Inventors: David Ray Leibrandt, Superior, CO (US); David Brian Hume, Boulder, CO (US); Roger Charles Brown, Atlanta, GA (US); Jeffrey Aaron Sherman, Louisville, CO (US)

(73) Assignee: GOVERNMENT OF THE UNITED STATES OF AMERICA, AS REPRESENTED BY THE SECRETARY OF COMMERCE, Gaithersburg, MD (US)

( * ) Notice: Subject to any disclaimer, the term of this patent is extended or adjusted under 35 U.S.C. 154(b) by 0 days.

(21) Appl. No.: 17/590,690

(22) Filed: Feb. 1, 2022

(65) Prior Publication Data

US 2022/0246419 A1 Aug. 4, 2022

Related U.S. Application Data

(60) Provisional application No. 63/144,066, filed on Feb. 1, 2021.

(51) Int. Cl.
*H01J 49/42* (2006.01)

(52) U.S. Cl.
CPC ..... *H01J 49/424* (2013.01); *H01J 49/4265* (2013.01)

(58) Field of Classification Search
CPC ..... H01J 49/424; H01J 49/4265
USPC ..... 250/281, 282, 283
See application file for complete search history.

(56) References Cited

U.S. PATENT DOCUMENTS

| | | | | |
|---|---|---|---|---|
| 5,379,000 | A | 1/1995 | Brewer et al. | |
| 2005/0258364 | A1* | 11/2005 | Whitehouse | H01J 49/42 250/283 |
| 2013/0009050 | A1* | 1/2013 | Park | H01J 49/063 250/281 |

(Continued)

OTHER PUBLICATIONS

Brewer, R.G., et al., "Planar ion microtraps", Phys. Review A, 1992, p. R6781-R6784, vol. 46 No. 11.

(Continued)

*Primary Examiner* — Nicole M Ippolito
(74) *Attorney, Agent, or Firm* — Office of Chief Counsel for National Institute of Standards and Technology

(57) ABSTRACT

A spherical ion trap includes a substrate and an ion aperture; two RF electrodes in electrostatic communication with an ion trapping region; RF ground electrodes in electrostatic communication with the ion trapping region; and the ion trapping region bounded by opposing RF electrodes and the RF ground electrodes, such that: the ion trapping region is disposed within the ion aperture and receives ions that are selectively trapped in the ion trapping region in response to receipt of DC and RF voltages by the RF electrodes, and receipt of the DC voltages by RF ground electrodes, and the first RF electrode, the second RF electrode, the RF ground electrodes, and the ion trapping region are disposed in the same plane within the ion aperture.

20 Claims, 14 Drawing Sheets

(56) References Cited

U.S. PATENT DOCUMENTS

2016/0181077 A1* 6/2016 Ouyang ..... H01J 49/0013
250/282
2019/0027365 A1* 1/2019 Chou ..... H01L 21/32139

OTHER PUBLICATIONS

Devoe, R.G., "Elliptical ion traps and trap arrays for quantum computation", Physical Review A, 1998, p. 910-914, vol. 58 No. 2.
Pearson, C.E., "Theory and Application of Planar Ion Traps", Masters thesis, Massachusetts Institute of Technology, 2006, p. 1-106.
Nisbet-Jones, P.B.R., et al., "A single-ion trap with minimized ion-environment interactions", Applied Physics B, 2016, p. 1-8, vol. 122 No. 57.
Opticlock, "Prototype commercial trapped ion optical atomic clock", Accessed Jan. 21, 2022, doi: www.opticlock.de/en/info.
Chen, J-S., "Ticking near the Zero-Point Energy: towards 1×10-18 Accuracy in AI+ Optical Clocks", Ph. D. thesis, University of Colorado, 2017, Accessed Jan. 21, 2022, doi: https://www.nist.gov/system/files/documents/2017/12/29/chen_thesis_main.pdf.
Paul, W., "Electromagnetic traps for charged and neutral particles", Reviews of Modem Physics, 1990, p. 531-540, vol. 6 No. 3.

* cited by examiner

SPHERICAL ION TRAP AND TRAPPING IONS

CROSS REFERENCE TO RELATED APPLICATIONS

This application claims the benefit of U.S. Provisional Patent Application Ser. No. 63/144,066 (filed Feb. 1, 2021), which is herein incorporated by reference in its entirety.

STATEMENT REGARDING FEDERALLY SPONSORED RESEARCH

This invention was made with United States Government support from the National Institute of Standards and Technology (NIST), an agency of the United States Department of Commerce. The Government has certain rights in this invention.

BRIEF DESCRIPTION

Disclosed is a spherical ion trap for trapping ions, the spherical ion trap comprising: a substrate comprising an electrical insulator and an ion aperture bounded by a substrate wall such that the ion aperture receives ions; a first RF electrode disposed on the substrate in electrostatic communication with an ion trapping region and that protrudes from the substrate wall into the ion aperture toward the ion trapping region and receives DC and RF voltage; a second RF electrode disposed on the substrate in electrostatic communication with the ion trapping region and that protrudes from the substrate wall into the ion aperture toward the ion trapping region, such that the second RF electrode is spaced apart from the first RF electrode, opposes the first RF electrode, and receives the DC and RF voltage; a plurality of RF ground electrodes disposed on the substrate in electrostatic communication with the ion trapping region and that protrudes from the substrate wall into the ion aperture toward the ion trapping region, such that the RF ground electrodes are spaced apart from each other and from the first RF electrode and the second RF electrode, and receive a DC voltage; and the ion trapping region bounded by opposing first RF electrode and second RF electrode and the RF ground electrodes, such that: the ion trapping region is disposed within the ion aperture and receives ions that are selectively trapped in the ion trapping region in response to receipt of the DC and RF voltage by the first RF electrode and the second RF electrode, and receipt of the DC voltages by the RF ground electrodes, and the first RF electrode, the second RF electrode, the RF ground electrodes, and the ion trapping region are disposed in the same plane within the ion aperture.

Disclosed is a process for trapping ions with a spherical ion trap, the process comprising: receiving, by an ion trapping region of a spherical ion trap, a plurality of ions, the spherical ion trap comprising: a substrate comprising an electrical insulator and an ion aperture bounded by a substrate wall such that the ion aperture receives the ions; a first RF electrode disposed on the substrate in electrostatic communication with an ion trapping region and that protrudes from the substrate wall into the ion aperture toward the ion trapping region and receives DC and RF voltage; a second RF electrode disposed on the substrate in electrostatic communication with the ion trapping region and that protrudes from the substrate wall into the ion aperture toward the ion trapping region, such that the second RF electrode is spaced apart from the first RF electrode, opposes the first RF electrode, and receives the DC voltage RF power; a plurality of RF ground electrodes disposed on the substrate in electrostatic communication with the ion trapping region and that protrudes from the substrate wall into the ion aperture toward the ion trapping region, such that the RF ground electrodes are spaced apart from each other and from the first RF electrode and the second RF electrode, and receive DC voltages; and the ion trapping region bounded by opposing first RF electrode and second RF electrode and the RF ground electrodes, such that: the ion trapping region is disposed within the ion aperture and receives ions that are selectively trapped in the ion trapping region in response to receipt of the DC and RF voltages by the first RF electrode and the second RF electrode, and receipt of the DC voltages by the RF ground electrodes, and the first RF electrode, the second RF electrode, the RF ground electrodes, and the ion trapping region are disposed in the same plane within the ion aperture; providing the first RF electrode and the second RF electrode with DC and RF voltage; providing the RF ground electrodes with the DC voltage; forming a trapping potential field in the ion trapping region by the DC and RF voltages; and trapping the ions in the ion trapping region in response to forming the trapping potential field from the DC and RF voltages.

BRIEF DESCRIPTION OF THE DRAWINGS

The following description cannot be considered limiting in any way. Various objectives, features, and advantages of the disclosed subject matter can be more fully appreciated with reference to the following detailed description of the disclosed subject matter when considered in connection with the following drawings, in which like reference numerals identify like elements.

DETAILED DESCRIPTION

Figure 1:
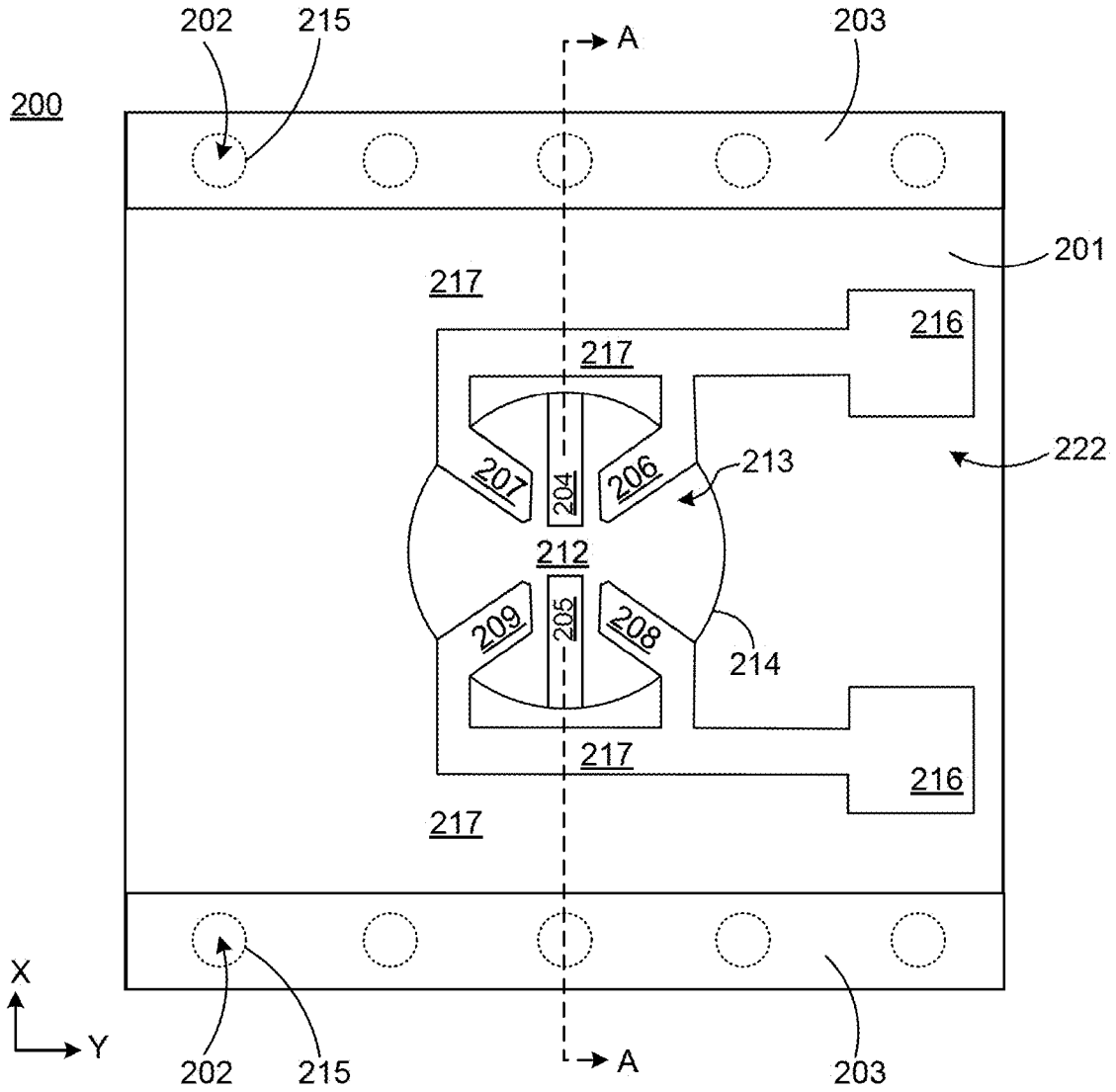
FIG. 1 shows a plan view of a first side of a spherical ion trap, according to some embodiments.
Figure 2:
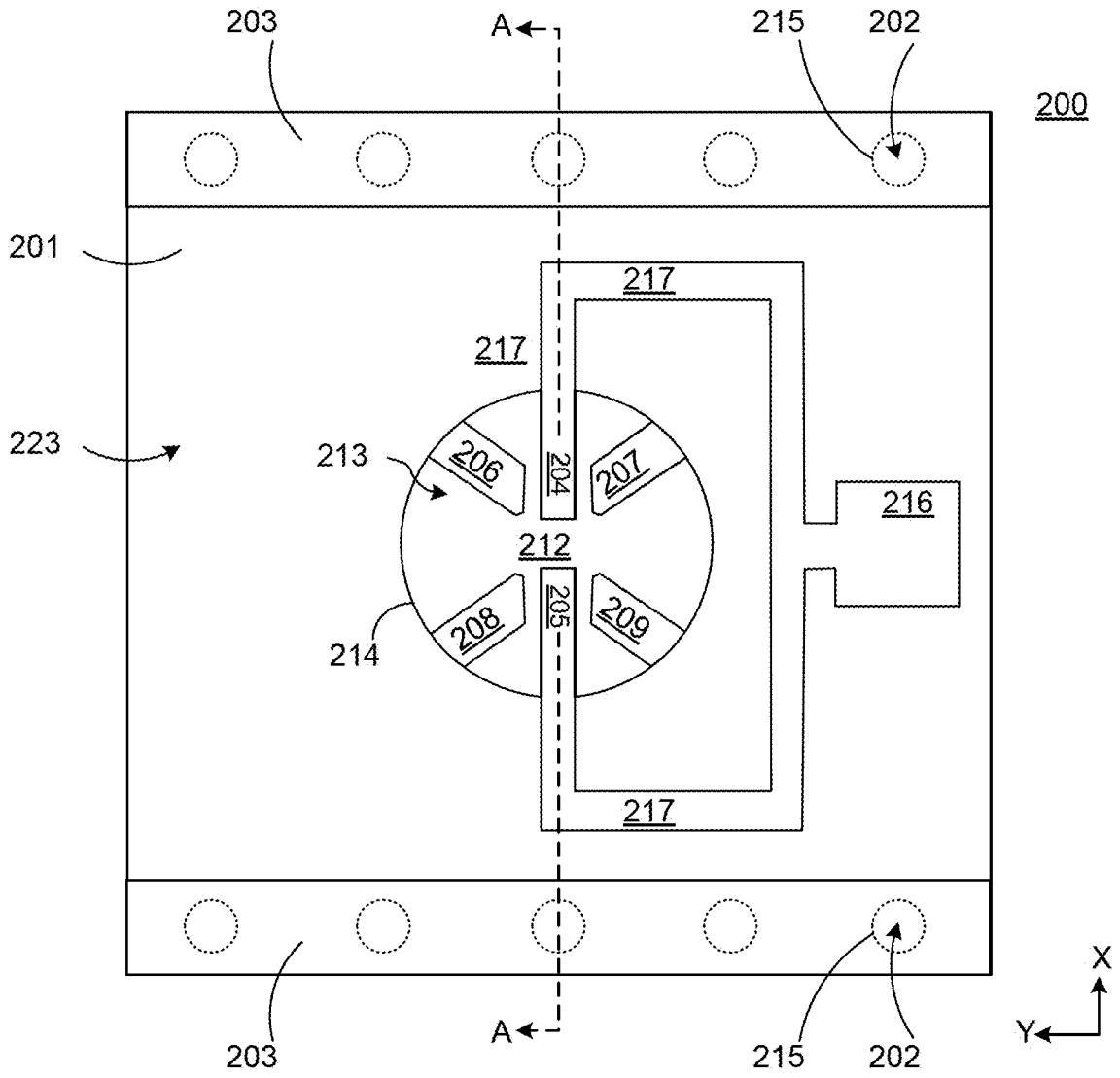
FIG. 2 shows a plan view of a second side of the spherical ion trap of FIG. 1, according to some embodiments.
Figure 3:
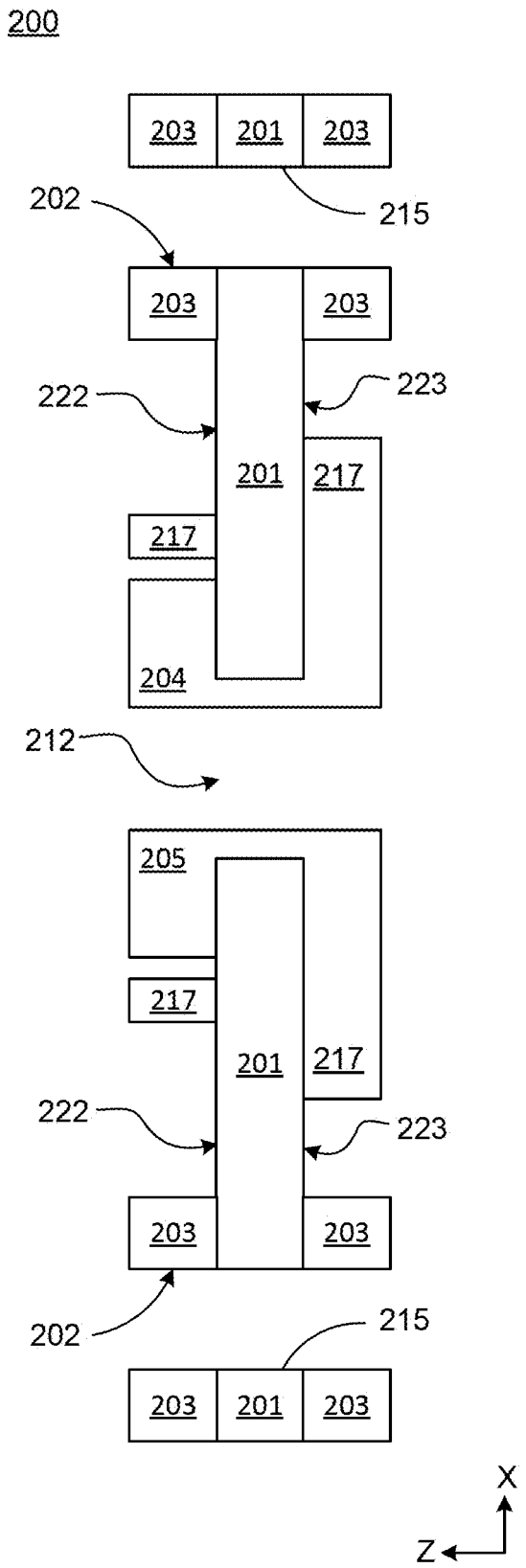
FIG. 3 shows a cross-section of the spherical ion trap of FIG. 1, according to some embodiments.

A detailed description of one or more embodiments is presented herein by way of exemplification and not limitation.

Conventional spherical RF Paul ion traps can include three-dimensional electrode structures to generate the electric fields for trapping ions or can include planar electrode structures that have low ion trapping efficiency. The original Paul ion trap is described in W. Paul, *Electromagnetic traps for charged and neutral particles*, Rev. Mod. Phys. 62, 531 (1990), the disclosure of which is incorporated by reference in its entirety. Some conventional ion traps includes a ring electrode situated between two end-cap electrodes or a toroidal configuration. The spherical ion trap described herein overcomes technical deviancies of the conventional ion traps and provides a high ion trapping efficiency with a planar electrode structure that can be formed by microfabrication.

It has been discovered that the spherical ion trap described herein can be used for compact and field-deployable atomic clocks, among other applications. The spherical ion trap can include a single electrically insulating wafer that is micromachined with metal patterned over some portions of the wafer to form the trap electrodes. Relative to conventional spherical RF Paul ion traps, the spherical ion trap described herein provides a beneficial combination of high trapping efficiency and compatibility with microfabrication techniques, wherein the spherical ion trap can be mass produced at low unit cost and with very small geometrical imperfections.

Spherical ion trap 200 can selectively trap ions. In an embodiment, with reference to FIG. 1, FIG. 2, FIG. 3, FIG. 4, FIG. 5, FIG. 6, FIG. 7, FIG. 8, FIG. 9, FIG. 10, FIG. 11, FIG. 12, FIG. 13, and FIG. 14, spherical ion trap 200 includes: a substrate 201 including an electrical insulator and an ion aperture 213 bounded by a substrate wall 214 such that the ion aperture 213 receives ions; a first RF electrode 204 disposed on the substrate 201 in electrostatic communication with an ion trapping region 212 and that protrudes from the substrate wall 214 into the ion aperture 213 toward the ion trapping region 212 and receives DC and RF voltage 225; a second RF electrode 205 disposed on the substrate 201 in electrostatic communication with the ion trapping region 212 and that protrudes from the substrate wall 214 into the ion aperture 213 toward the ion trapping region 212, such that the second RF electrode 205 is spaced apart from the first RF electrode 204, opposes the first RF electrode 204, and receives the DC and RF voltage 225; a plurality of RF ground electrodes (206, 207, 208, 209) disposed on the substrate 201 in electrostatic communication with the ion trapping region 212 and that protrudes from the substrate wall 214 into the ion aperture 213 toward the ion trapping region 212, such that the RF ground electrodes (206, 207, 208, 209) are spaced apart from each other and from the first RF electrode 204 and the second RF electrode 205, and receive a DC voltage 224; and the ion trapping region 212 bounded by opposing first RF electrode 204 and second RF electrode 205 and the RF ground electrodes, such that: the ion trapping region 212 is disposed within the ion aperture 213 and receives ions that are selectively trapped in the ion trapping region 212 in response to receipt of the DC voltage RF power 225 by the first RF electrode 204 and the second RF electrode 205, and receipt of the DC voltage 224 by RF ground electrodes, and the first RF electrode 204, the second RF electrode 205, the RF ground electrodes, and the ion trapping region 212 are disposed in the same plane within the ion aperture 213.

A number, size, and shape of the RF ground electrodes can be selected to provide for adequate compensation of stray fields or to provide a tailored electrostatic potential of the ion trapping region 212.

Figure 9:
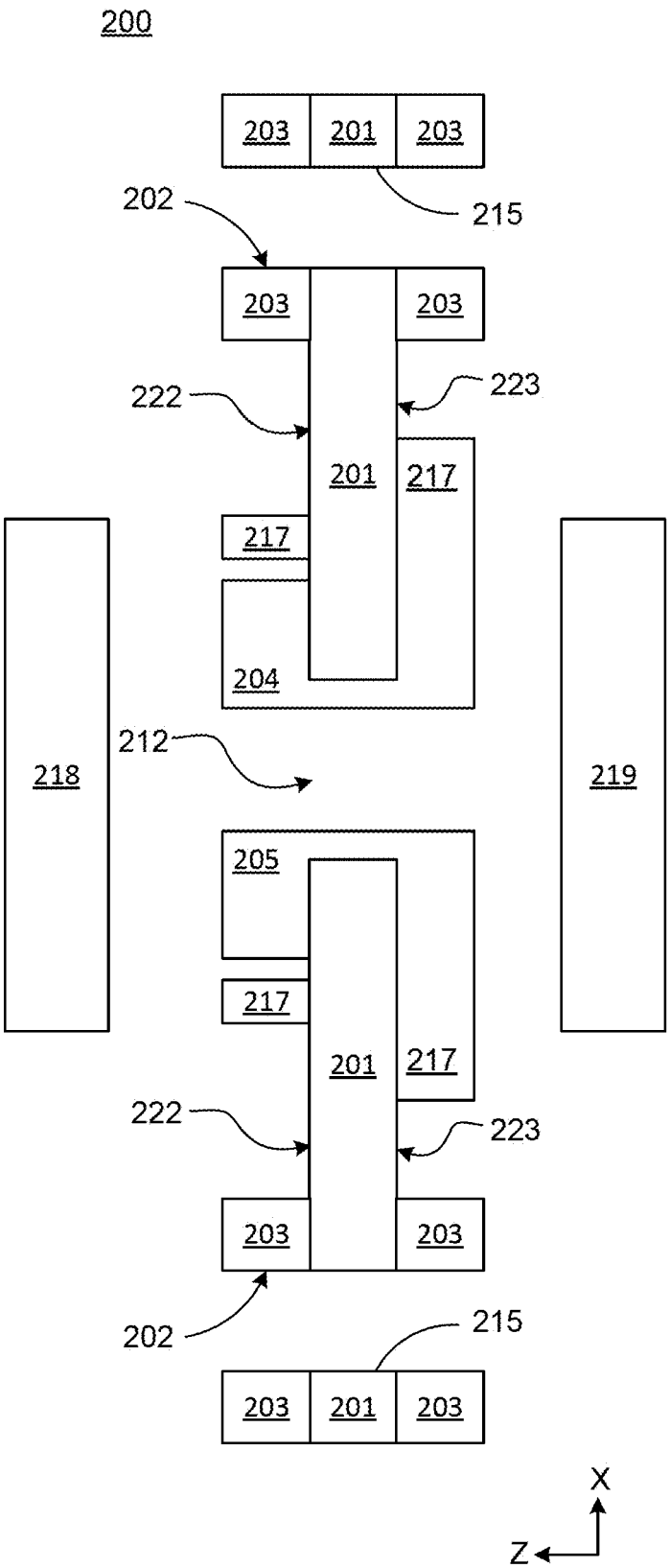
FIG. 9 shows a cross-section of the spherical ion trap of FIG. 7, according to some embodiments.
Figure 10:
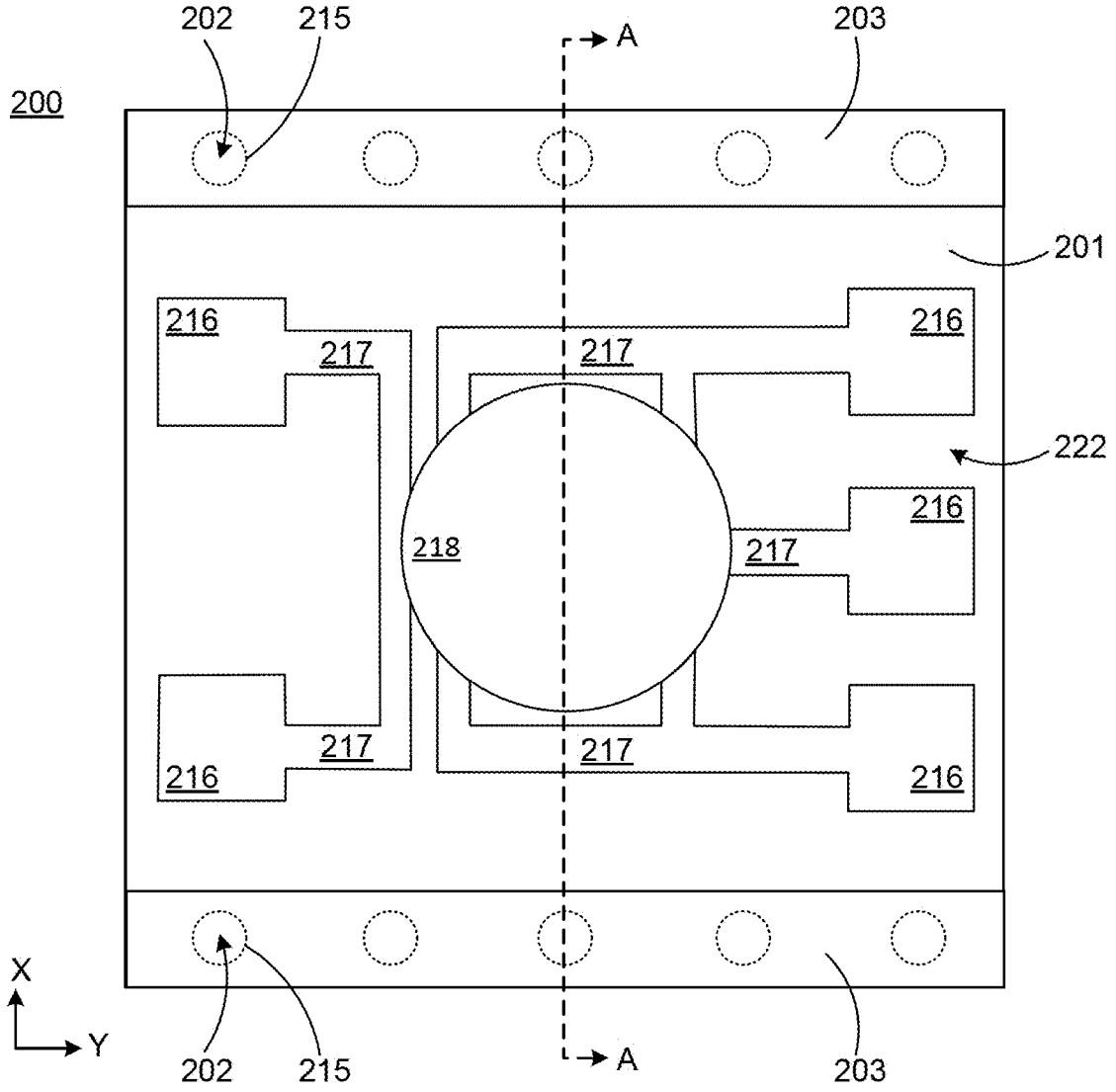
FIG. 10 shows a plan view of a first side of a spherical ion trap, according to some embodiments.
Figure 11:
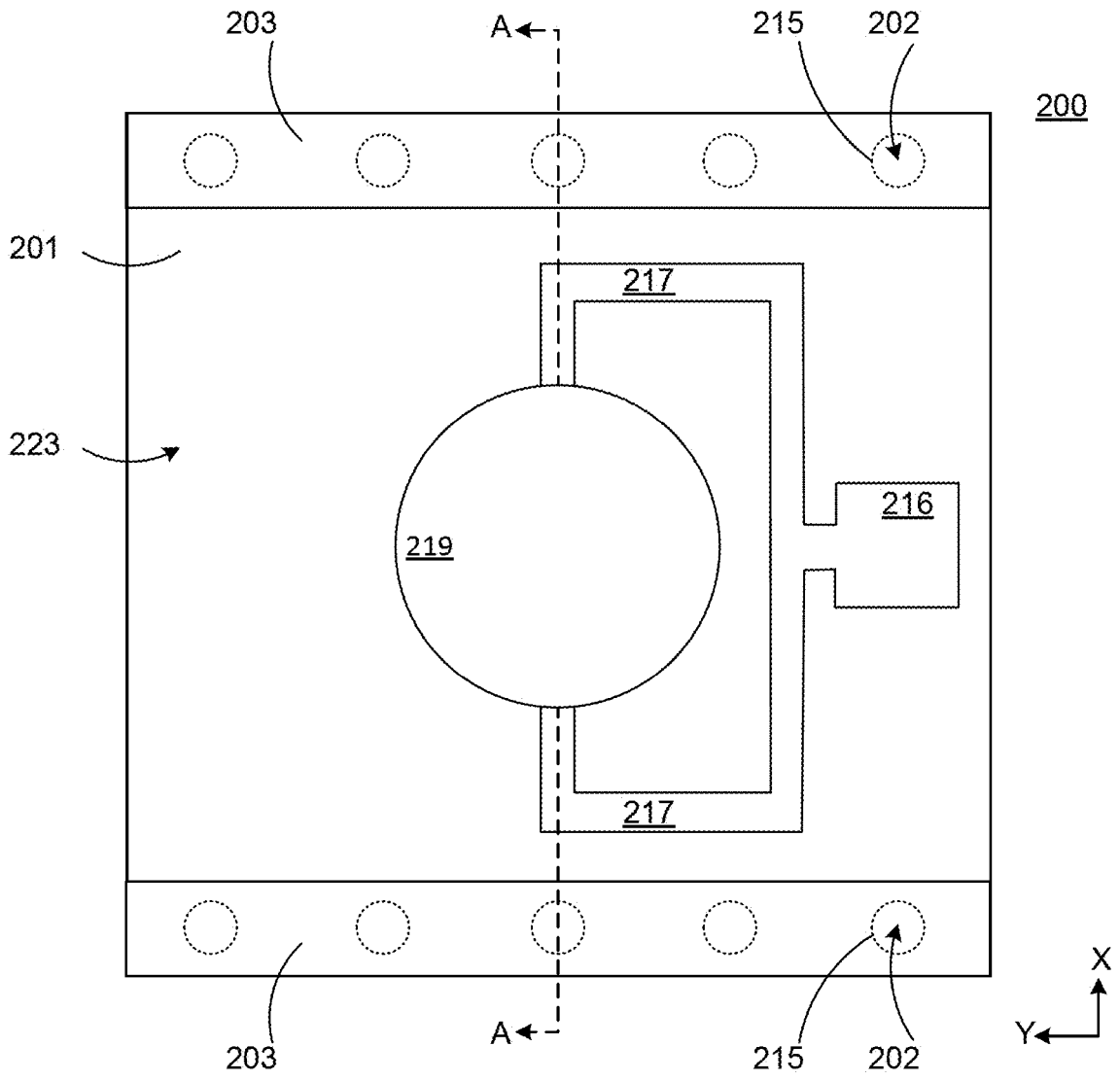
FIG. 11 shows a plan view of a second side of the spherical ion trap of FIG. 10, according to some embodiments.
Figure 14:
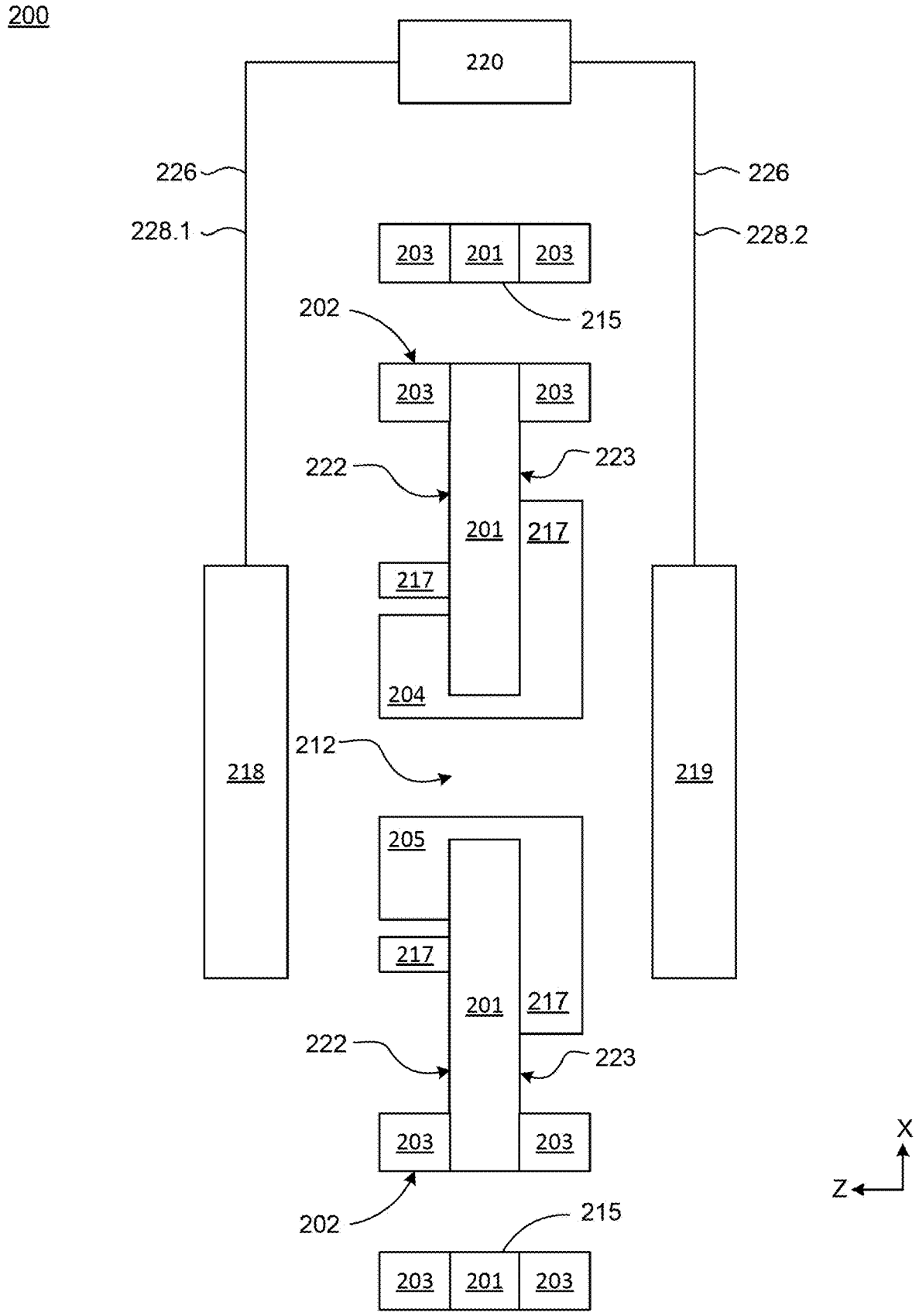
FIG. 14 shows a cross-section of the spherical ion trap of FIG. 12, according to some embodiments.

In an embodiment, with reference to FIG. 7, FIG. 9, FIG. 10, and FIG. 14, spherical ion trap 200 includes a first ancillary compensation electrode 218 in electrostatic communication with the ion trapping region 212 and that receives a first compensation DC voltage 228. In an embodiment, with reference to FIG. 8, FIG. 9, FIG. 11, and FIG. 14, spherical ion trap 200 includes a second ancillary compensation electrode 219 in electrostatic communication with the ion trapping region 212 and that receives a second compensation DC voltage 228. In an embodiment, the first ancillary compensation electrode 218 opposes the second ancillary compensation electrode 219 across the ion trapping region 212, as shown in FIG. 9 and FIG. 14. In an embodiment, first ancillary compensation electrode 218 and the second ancillary compensation electrode 219 are disposed out of the plane in which the first RF electrode 204, the second RF electrode 205, the RF ground electrodes, and the ion trapping region 212 are disposed. A size and shape of first ancillary compensation electrode 218 and the second ancillary compensation electrode 219 can be selected to provide for adequate compensation of stray fields or to provide a tailored electrostatic potential of the ion trapping region 212.

In an embodiment, with reference to FIG. 4, FIG. 5, FIG. 6, FIG. 10, FIG. 11, FIG. 12, FIG. 13, and FIG. 14, spherical ion trap 200 includes a plurality of in-plane compensation electrodes (e.g., 210, 211) in electrostatic communication with the ion trapping region 212 and that receives a compensation DC voltage 229. The in-plane compensation electrodes (e.g., 210, 211) are disposed in the plane in which the first RF electrode 204, the second RF electrode 205, the RF ground electrodes, and the ion trapping region 212 are disposed. A number of the in-plane compensation electrodes can be selected to provide for adequate compensation of stray electric fields or to provide a tailored electrostatic potential of the ion trapping region 212. In an embodiment, with reference to FIG. 4, the in-plane compensation electrodes include a first in-plane compensation electrode 210 and a second in-plane compensation electrode 211. In an embodiment, the first in-plane compensation electrode 210 and the second in-plane compensation electrode 211 protrude from the substrate wall 214 into the ion aperture 213 toward the ion trapping region 212, such that the first in-plane compensation electrode 210 is spaced apart from and opposes the second in-plane compensation electrode 211.

A thickness of the first RF electrode 204, the second RF electrode 205, the RF ground electrodes, and the ion trapping region 212 can be sufficient to form the trapping potential field in the ion trapping region 212. It is contemplated that the thickness of the individual electrodes independently can be from 50 μm to 10 mm, e.g., 300 μm. A length of the electrodes (204-211) can be selected based on a size of the ion trapping region 212 desired in consideration of the size (e.g., radius) of the ion aperture 213. It should be appreciated that ion aperture 213 provides for communication of ions that are transmitted through ion aperture 213.

Figure 12:
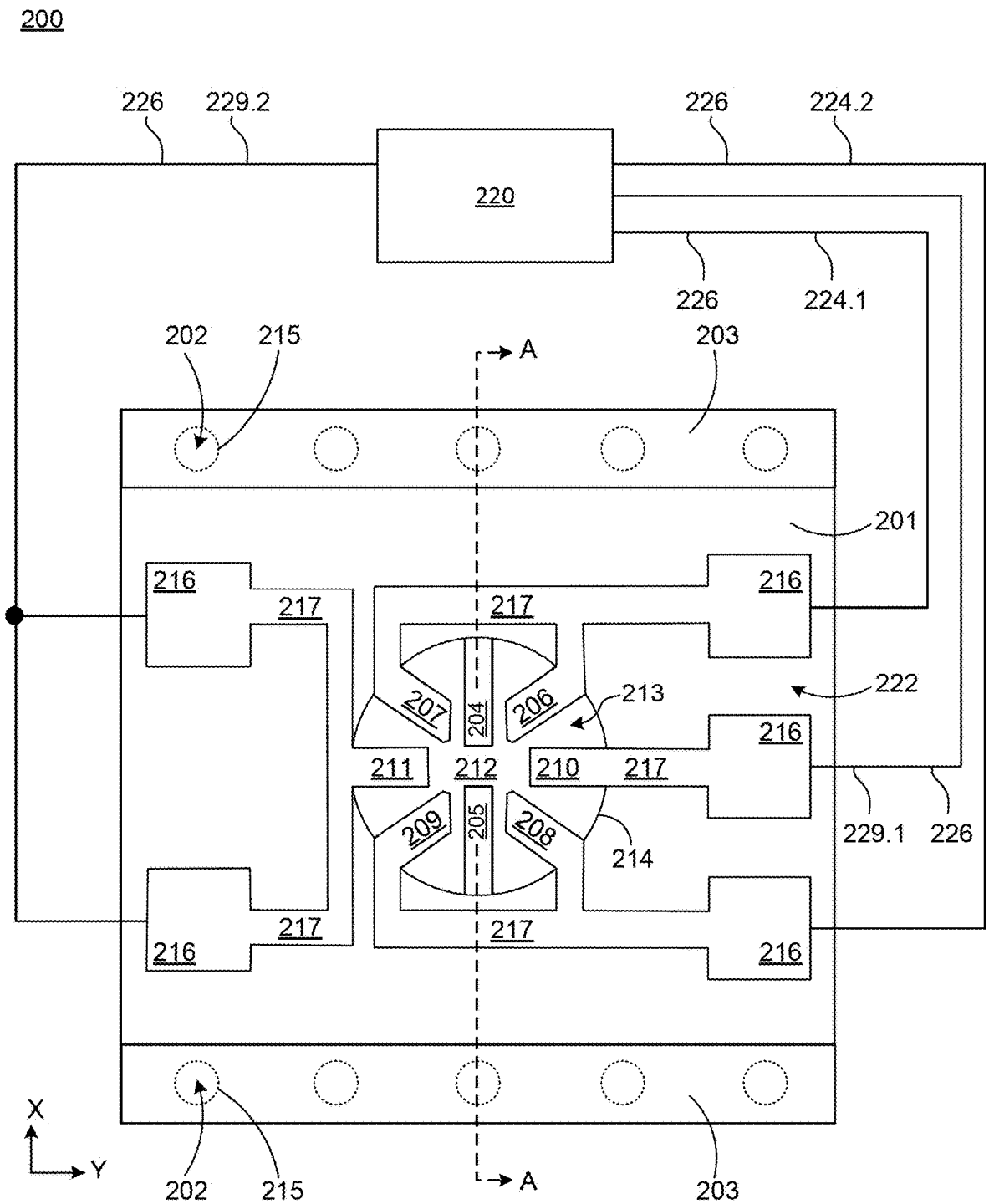
FIG. 12 shows a plan view of a first side of a spherical ion trap, according to some embodiments.
Figure 13:
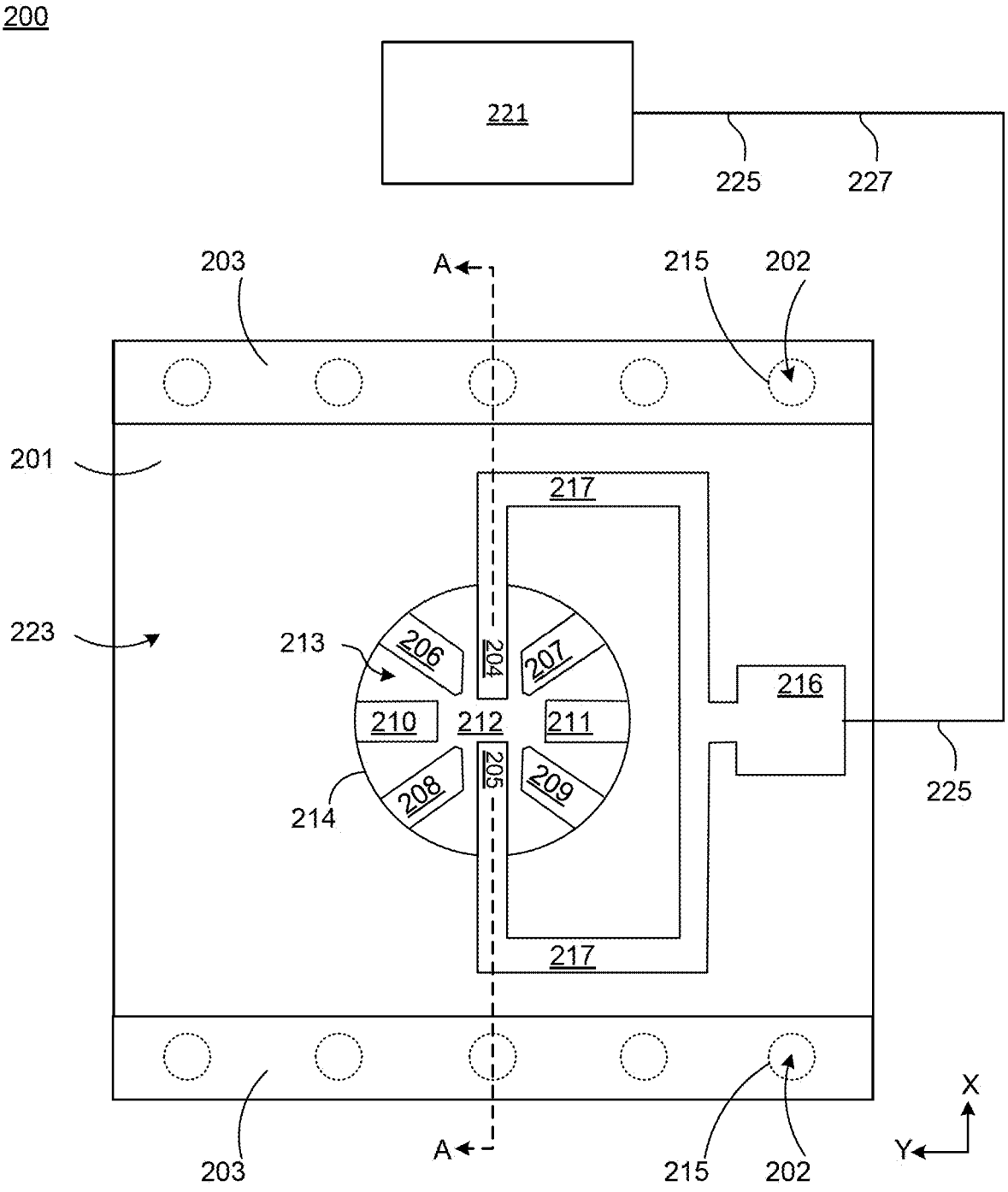
FIG. 13 shows a plan view of a second side of the spherical ion trap of FIG. 12, according to some embodiments.

Some of the figures show disposal of electrical wiring trace 217 that connects electrical contact pad 216 to a certain electrode (e.g., 204-211) via electrical wiring trace 217. The electrical contact pad 216 can electrically interconnect an electrode (e.g., one of 204-211) to an power source such as DC voltage source 220 or DC and RF voltage source 221, as shown in FIG. 12, FIG. 13, or FIG. 14. In this manner, DC voltage source 220 can provide various independent DC voltage 224 (e.g., 224.1, 224.2, 224.3, 224.4, 224.5) via voltage transmission lines 226 to RF ground electrode 206, RF ground electrode 207, RF ground electrode 208, RF ground electrode 209, in-plane compensation electrode 210, in-plane compensation electrode 211, first ancillary compensation electrode 218, or second ancillary compensation electrode 219, wherein the voltage waveforms (of e.g., 224.1, 224.2, 224.3, 224.4, 224.5) can be selected in view of the desired ion trapping conditions. Moreover, DC and RF voltage source 221 can provide RF transmission line 227 via RF transmission line 227 to first RF electrode 204 and second RF electrode 205, wherein the waveforms of RF transmission line 227 can be selected in view of the desired ion trapping conditions, e.g., a mass-to-charge, shape or size of ion trapping region 212, and the like.

Elements of spherical ion trap 200 can be made of a material that is physically or chemically resilient in an environment in which spherical ion trap 200 is disposed. Exemplary materials include a metal, ceramic, thermoplastic, glass, semiconductor, and the like. Some of the elements of spherical ion trap 200 can be made of the same or different material and can be monolithic in a single physical body or can be separate members that are physically joined.

Spherical ion trap 200 can be made in various ways. It should be appreciated that spherical ion trap 200 includes a number of electrical or mechanical components, wherein such components can be interconnected and placed in communication (e.g., optical communication, electrical communication, mechanical communication, fluid communication, and the like) by physical, chemical, or mechanical interconnects. The components can be disposed on mounts that can be disposed on a bulkhead for alignment or physical compartmentalization. As a result, spherical ion trap 200 can be disposed in a terrestrial environment or space environment. Elements of spherical ion trap 200 can be formed from silicon, aluminum nitride, diamond, and the like although other suitable materials, such ceramic, glass, or metal can be used. According to an embodiment, the elements of spherical ion trap 200 are formed using semiconductor microfabrication techniques although the elements of spherical ion trap 200 can be formed using other methods, such as 3D printing, injection molding, or machining a stock material such as block of material that is subjected to removal of material such as by cutting, laser ablation, and the like. Accordingly, spherical ion trap 200 can be made by additive or subtractive manufacturing. In an embodiment, elements of spherical ion trap 200 are selectively etched to remove various different materials using different etchants and photolithographic masks and procedures. The various layers thus formed can be subjected to joining by bonding to form spherical ion trap 200.

Figure 4:
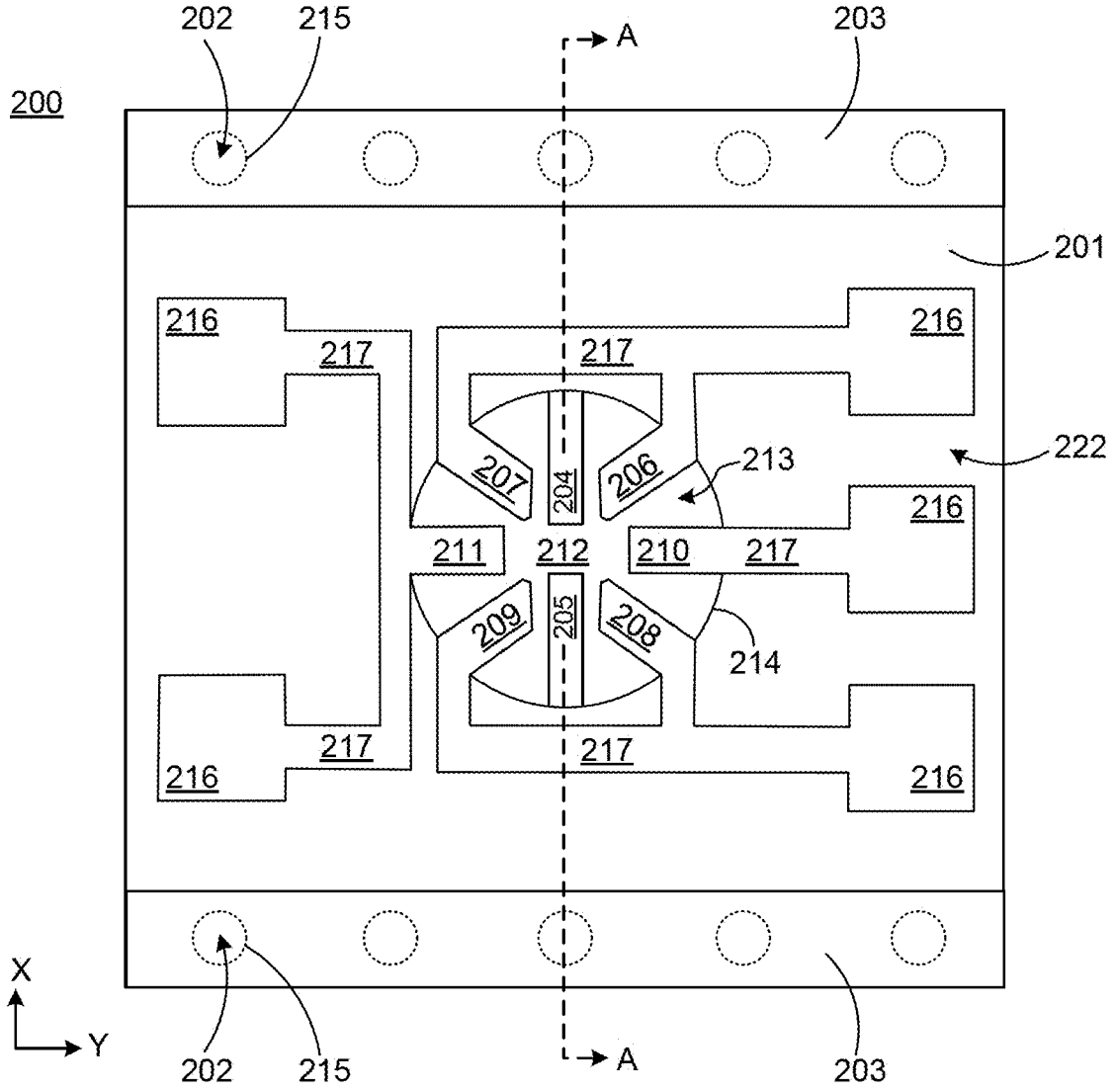
FIG. 4 shows a plan view of a first side of a spherical ion trap, according to some embodiments.
Figure 5:
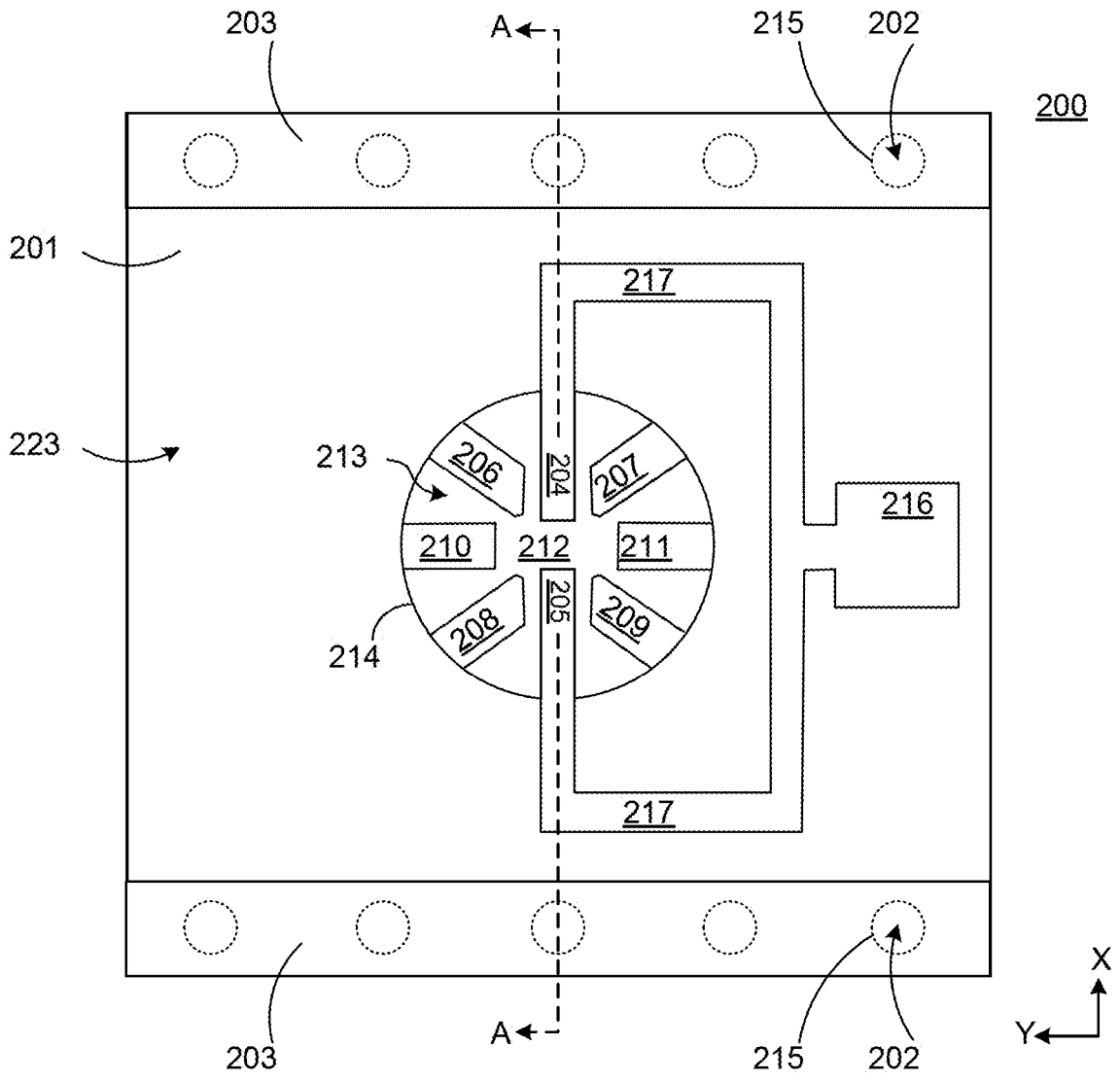
FIG. 5 shows a plan view of a second side of the spherical ion trap of FIG. 4, according to some embodiments.
Figure 6:
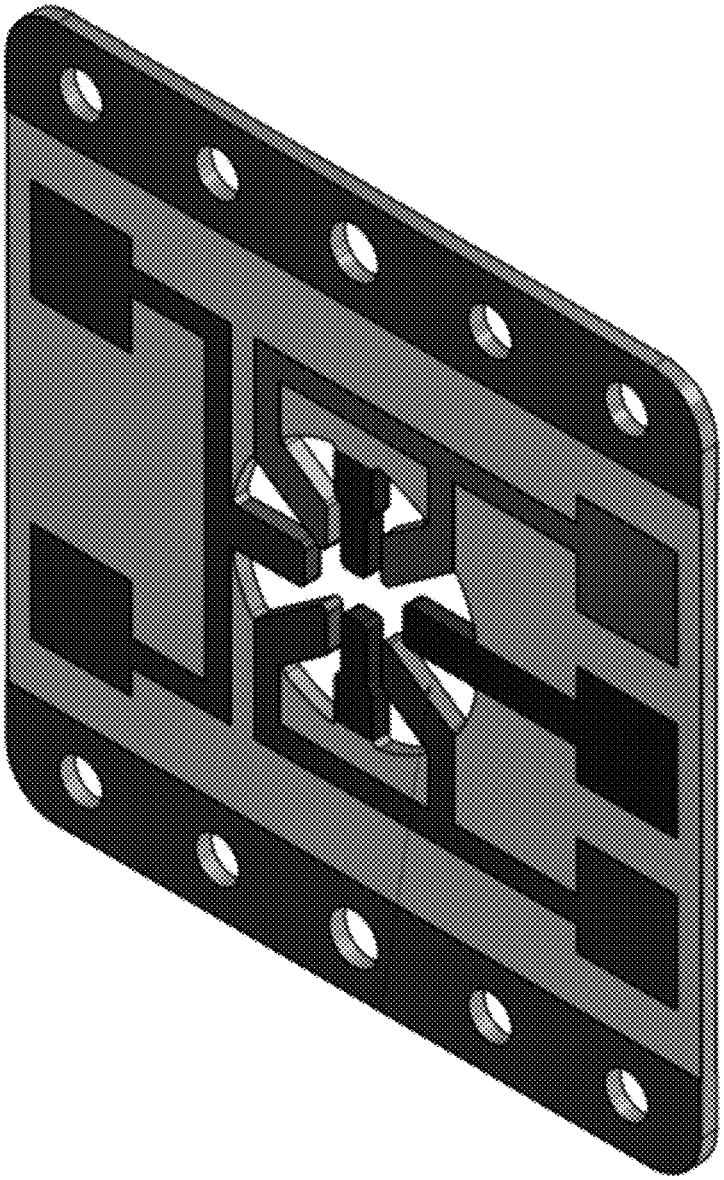
FIG. 6 shows a perspective view of the spherical ion trap of FIG. 4, according to some embodiments.
Figure 7:
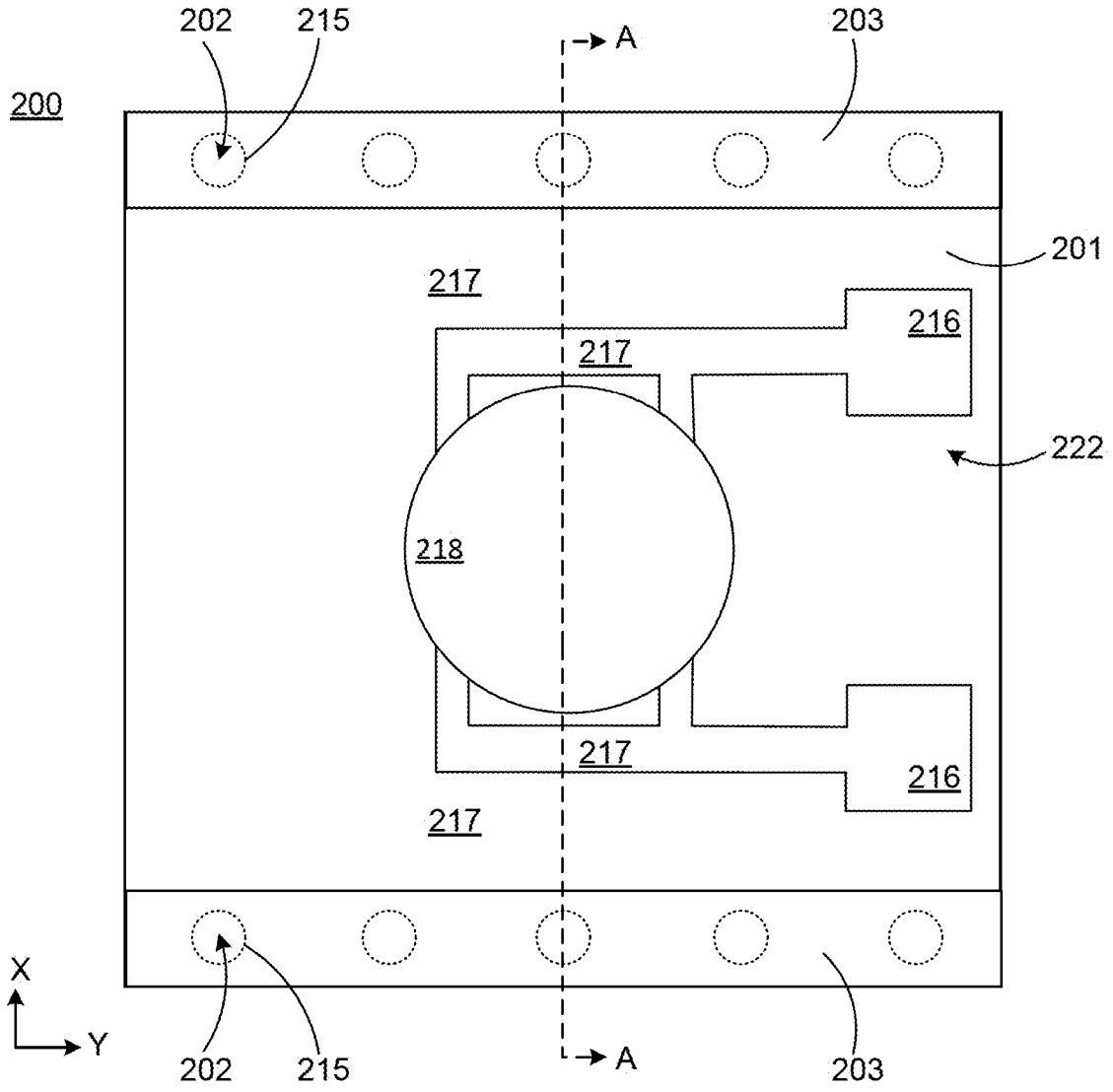
FIG. 7 shows a plan view of a first side of a spherical ion trap, according to some embodiments.
Figure 8:
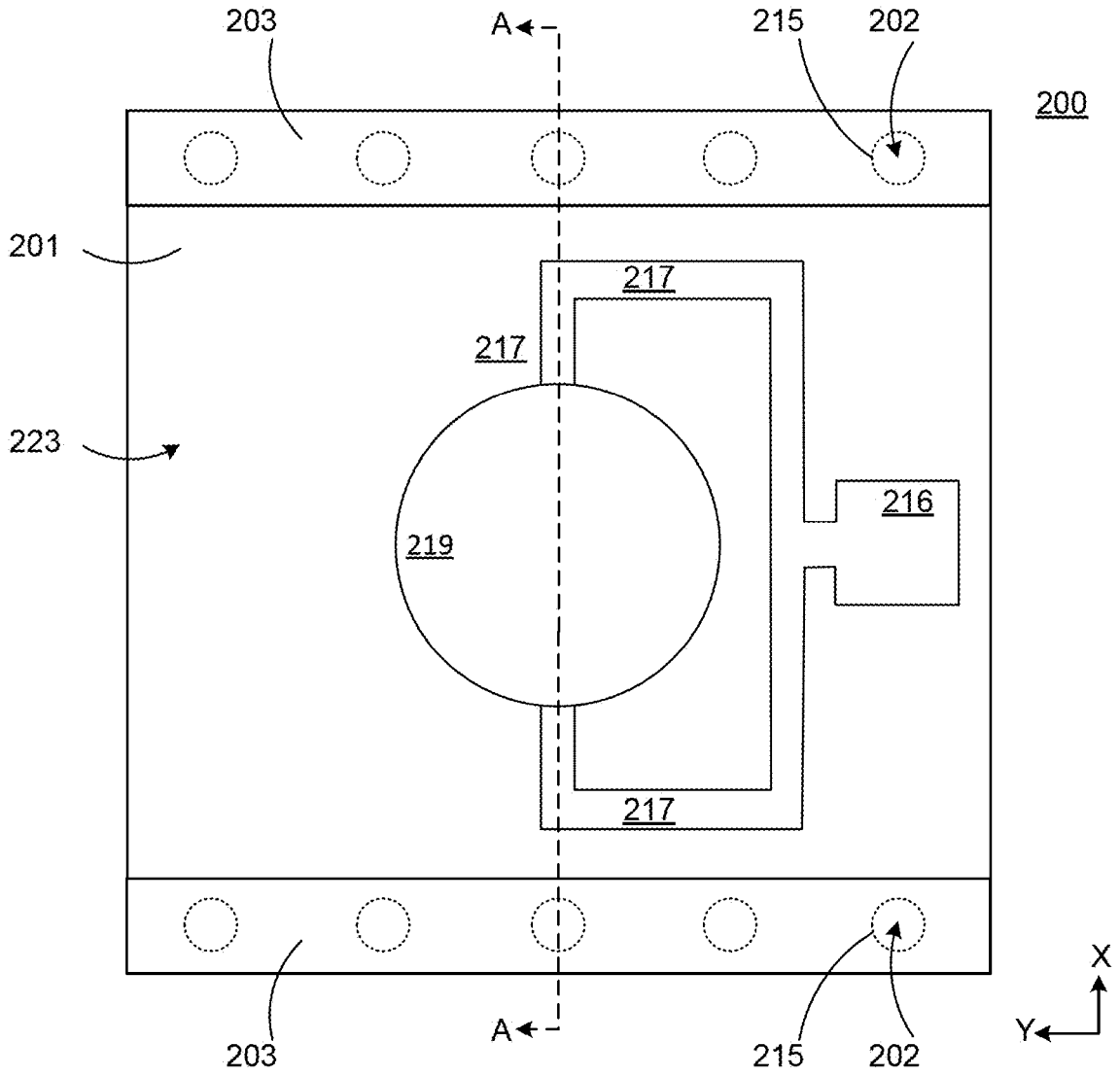
FIG. 8 shows a plan view of a second side of the spherical ion trap of FIG. 7, according to some embodiments.

In an embodiment, spherical ion trap 200 is fabricated by cutting the shape shown, e.g., in FIG. 4, out of a single electrically insulating wafer and patterning metal electrodes onto the areas each electrode. Cutting can be performed using laser machining, chemical etching, ion milling, or other microfabrication techniques. Metal patterning can be performed, e.g., by shadow masked sputtering or evaporation.

Spherical ion trap 200 has numerous advantageous and unexpected benefits and uses. In an embodiment, a process for trapping ions includes: receiving, by an ion trapping region 212 of a spherical ion trap 200, a plurality of ions, the spherical ion trap 200 including: a substrate 201 including an electrical insulator and an ion aperture 213 bounded by a substrate wall 214 such that the ion aperture 213 receives the ions; a first RF electrode 204 disposed on the substrate 201 in electrostatic communication with an ion trapping region 212 and that protrudes from the substrate wall 214 into the ion aperture 213 toward the ion trapping region 212 and receives DC and RF voltage 225; a second RF electrode 205 disposed on the substrate 201 in electrostatic communication with the ion trapping region 212 and that protrudes from the substrate wall 214 into the ion aperture 213 toward the ion trapping region 212, such that the second RF electrode 205 is spaced apart from the first RF electrode 204, opposes the first RF electrode 204, and receives the DC and RF voltage 225; a plurality of RF ground electrodes disposed on the substrate 201 in electrostatic communication with the ion trapping region 212 and that protrudes from the substrate wall 214 into the ion aperture 213 toward the ion trapping region 212, such that the RF ground electrodes are spaced apart from each other and from the first RF electrode 204 and the second RF electrode 205, and receive a DC voltage 224; and the ion trapping region 212 bounded by opposing first RF electrode 204 and second RF electrode 205 and the RF ground electrodes, such that: the ion trapping region 212 is disposed within the ion aperture 213 and receives ions that are selectively trapped in the ion trapping region 212 in response to receipt of the DC voltage RF power 225 by the first RF electrode 204 and the second RF electrode 205, and receipt of the DC voltage 224 by RF ground electrodes, and the first RF electrode 204, the second RF electrode 205, the RF ground electrodes, and the ion trapping region 212 are disposed in the same plane within the ion aperture 213; providing the first RF electrode 204 and the second RF electrode 205 with DC and RF voltage 225; providing the RF ground electrodes with the DC voltage 224; forming a trapping potential field in the ion trapping region 212 by the DC and RF voltage 225 and the DC voltage 224; and trapping the ions in the ion trapping region 212 in response to forming the trapping potential field from the DC and RF voltage 225 and the DC voltage 224.

The process for trapping ions can include tuning the trapping potential field to trap ions having a selected mass-to-charge ratio in the ion trapping region 212 and destabilizing trajectories of other ions that do not have the selected mass-to-charge ratio, resulting in the other ions not being trapped in the ion trapping region 212.

In the process for trapping ions, the spherical ion trap 200 can include a first ancillary compensation electrode 218 in electrostatic communication with the ion trapping region 212, such that the first ancillary compensation electrode 218 receives a first compensation DC voltage 228; and the process can include providing the first compensation DC voltage 228 to the first ancillary compensation electrode 218 to trap ions in the ion trapping region 212.

In the process for trapping ions, the spherical ion trap 200 can include a second ancillary compensation electrode 219 in electrostatic communication with the ion trapping region 212 and that receives a second compensation DC voltage 228; the first ancillary compensation electrode 218 opposes the second ancillary compensation electrode 219 across the ion trapping region 212; and the process can include providing the second shielding DC voltage 228 to the second ancillary compensation electrode 219 to trap ions in the ion trapping region 212.

In the process for trapping ions, the first ancillary compensation electrode 218 and the second ancillary compensation electrode 219 can be disposed out of the plane in which the first RF electrode 204, the second RF electrode 205, the RF ground electrodes, and the ion trapping region 212 are disposed. In the process for trapping ions, the spherical ion trap 200 can include a plurality of in-plane compensation electrodes 210 in electrostatic communication with the ion trapping region 212 and that receives a compensation DC voltage 229; and the process can include providing the compensation DC voltage 229 to the in-plane compensation electrodes 210 to trap ions in the ion trapping region 212.

In the process for trapping ions, the in-plane compensation electrodes can be disposed in the plane in which the first RF electrode 204, the second RF electrode 205, the RF ground electrodes, and the ion trapping region 212 are disposed. The in-plane compensation electrodes can include comprise a first in-plane compensation electrode 211 and a second in-plane compensation electrode 211. The first in-plane compensation electrode 210 and the second in-plane compensation electrode 211 can protrude from the substrate wall 214 into the ion aperture 213 toward the ion trapping region 212, such that the first in-plane compensation electrode 210 is spaced apart from and opposes the second in-plane compensation electrode 211.

In an embodiment, a process for trapping ions with spherical ion trap 200 includes, applying a radiofrequency voltage to first RF electrode 204 and second RF electrode 205, while the other electrodes (206-211, 218, 219 if present) are electrically grounded or held at DC voltages for compensation of stray electric fields present in the environment. Here, the ratios of the secular motion frequencies along the three principal axes are determined by the geometry of the electrodes near the position of the ion and the DC and RF voltages, and can be set within a wide range to optimize performance for the specific application. The ion(s) is trapped at the geometric center of the electrodes.

Spherical ion trap 200 is advantageous over conventional three-dimensional spherical Paul traps since spherical ion trap 200 can be microfabricated so that spherical ion trap 200 can be mass produced at low unit cost. The RF electrodes 204 and 205 are technically superior to conventional machined three-dimensional spherical Paul traps since machining imperfections can be much smaller with microfabrication than with conventional machining, and machining imperfections can lead to deviations from the desired principal axis directions and secular frequencies as well as excess micromotion. The spherical ion trap 200 may be technically superior to conventional planar spherical Paul traps since spherical ion trap 200 has high trapping efficiency so that lower voltages are used for operation, which provides reductions in the size, weight, and power of deployed systems using the spherical ion trap 200 as compared with conventional ion traps.

While one or more embodiments have been shown and described, modifications and substitutions may be made thereto without departing from the spirit and scope of the invention. Accordingly, it is to be understood that the present invention has been described by way of illustrations and not limitation. Embodiments herein can be used independently or can be combined.

All ranges disclosed herein are inclusive of the endpoints, and the endpoints are independently combinable with each other. The ranges are continuous and thus contain every value and subset thereof in the range. Unless otherwise stated or contextually inapplicable, all percentages, when expressing a quantity, are weight percentages. The suffix (s) as used herein is intended to include both the singular and the plural of the term that it modifies, thereby including at least one of that term (e.g., the colorant(s) includes at least one colorants). Option, optional, or optionally means that the subsequently described event or circumstance can or cannot occur, and that the description includes instances where the event occurs and instances where it does not. As used herein, combination is inclusive of blends, mixtures, alloys, reaction products, collection of elements, and the like.

As used herein, a combination thereof refers to a combination comprising at least one of the named constituents, components, compounds, or elements, optionally together with one or more of the same class of constituents, components, compounds, or elements.

All references are incorporated herein by reference.

The use of the terms "a," "an," and "the" and similar referents in the context of describing the invention (especially in the context of the following claims) are to be construed to cover both the singular and the plural, unless otherwise indicated herein or clearly contradicted by context. It can further be noted that the terms first, second, primary, secondary, and the like herein do not denote any order, quantity, or importance, but rather are used to distinguish one element from another. It will also be understood that, although the terms first, second, etc. are, in some instances, used herein to describe various elements, these elements should not be limited by these terms. For example, a first current could be termed a second current, and, similarly, a second current could be termed a first current, without departing from the scope of the various described embodiments. The first current and the second current are both currents, but they are not the same condition unless explicitly stated as such.

The modifier about used in connection with a quantity is inclusive of the stated value and has the meaning dictated by the context (e.g., it includes the degree of error associated with measurement of the particular quantity). The conjunction or is used to link objects of a list or alternatives and is not disjunctive; rather the elements can be used separately or can be combined together under appropriate circumstances.

What is claimed is:

1. A spherical ion trap for trapping ions, the spherical ion trap comprising:

a substrate comprising an electrical insulator and an ion aperture bounded by a substrate wall such that the ion aperture receives ions;

a first RF electrode disposed on the substrate in electrostatic communication with an ion trapping region and that protrudes from the substrate wall into the ion aperture toward the ion trapping region and receives DC and RF voltage;

a second RF electrode disposed on the substrate in electrostatic communication with the ion trapping region and that protrudes from the substrate wall into the ion aperture toward the ion trapping region, such that the second RF electrode is spaced apart from the first RF electrode, opposes the first RF electrode, and receives the DC and RF voltage;

a plurality of RF ground electrodes disposed on the substrate in electrostatic communication with the ion trapping region and that protrudes from the substrate wall into the ion aperture toward the ion trapping region, such that the RF ground electrodes are spaced apart from each other and from the first RF electrode and the second RF electrode, and receive a DC voltage; and the ion trapping region bounded by opposing first RF electrode and second RF electrode and the RF ground electrodes, such that:

the ion trapping region is diposed within the ion aperture and receives ions that are selectively trapped in the ion trapping region in response to receipt of the DC and RF voltage by the first RF electrode and the second RF electrode, and receipt of the DC voltages by RF ground electrodes, and the first RF electrode, the second RF electrode, the RF ground electrodes, and the ion trapping region are disposed in the same plane within the ion aperture.

2. The spherical ion trap of claim 1, further comprising a first ancillary compensation electrode in electrostatic communication with the ion trapping region and that receives a first compensation DC voltage.

3. The spherical ion trap of claim 2, further comprising a second ancillary compensation electrode in electrostatic communication with the ion trapping region and that receives a second compensation DC voltage.

4. The spherical ion trap of claim 3, wherein the first ancillary compensation electrode opposes the second ancillary compensation electrode across the ion trapping region.

5. The spherical ion trap of claim 4, wherein the first ancillary compensation electrode and the second ancillary compensation electrode are disposed out of the plane in which the first RF electrode, the second RF electrode, the RF ground electrodes, and the ion trapping region are disposed.

6. The spherical ion trap of claim 1, further comprising a plurality of in-plane compensation electrodes in electrostatic communication with the ion trapping region and that receive compensation DC voltages.

7. The spherical ion trap of claim 6, wherein the in-plane compensation electrodes are disposed in the plane in which the first RF electrode, the second RF electrode, the RF ground electrodes, and the ion trapping region are disposed.

8. The spherical ion trap of claim 7, wherein the in-plane compensation electrodes comprise a first in-plane compensation electrode and a second in-plane compensation electrode.

9. The spherical ion trap of claim 8, wherein the first in-plane compensation electrode and the second in-plane compensation electrode protrude from the substrate wall into the ion aperture toward the ion trapping region, such that the first in-plane compensation electrode is spaced apart from and opposes the second in-plane compensation electrode.

10. The spherical ion trap of claim 1, wherein a thickness of the first RF electrode, the second RF electrode, the RF ground electrodes, and the ion trapping region is from 50 μm to 5 mm.

11. A process for trapping ions with a spherical ion trap, the process comprising:

receiving, by an ion trapping region of a spherical ion trap, a plurality of ions, the spherical ion trap comprising:

a substrate comprising an electrical insulator and an ion aperture bounded by a substrate wall such that the ion aperture receives the ions;

a first RF electrode disposed on the substrate in electrostatic communication with an ion trapping region and that protrudes from the substrate wall into the ion aperture toward the ion trapping region and receives DC and RF voltage;

a second RF electrode disposed on the substrate in electrostatic communication with the ion trapping region and that protrudes from the substrate wall into the ion aperture toward the ion trapping region, such that the second RF electrode is spaced apart from the first RF electrode, opposes the first RF electrode, and receives the DC and RF voltage;

a plurality of RF ground electrodes disposed on the substrate in electrostatic communication with the ion trapping region and that protrudes from the substrate wall into the ion aperture toward the ion trapping region, such that the RF ground electrodes are spaced apart from each other and from the first RF electrode and the second RF electrode, and receive a DC voltage; and the ion trapping region bounded by opposing first RF electrode and second RF electrode and the RF ground electrodes, such that:

the ion trapping region is diposed within the ion aperture and receives ions that are selectively trapped in the ion trapping region in response to receipt of the DC and RF voltage by the first RF electrode and the second RF electrode, and receipt of the DC voltage by RF ground electrodes, and the first RF electrode, the second RF electrode, the RF ground electrodes, and the ion trapping region are disposed in the same plane within the ion aperture;

providing the first RF electrode and the second RF electrode with DC and RF voltage;

providing the RF ground electrodes with the DC voltage;

forming a trapping potential field in the ion trapping region by the DC voltage RF power and the DC voltage; and trapping the ions in the ion trapping region in response to forming the trapping potential field from the DC and RF voltages.

12. The process of claim 11, further comprising tuning the trapping potential field to trap ions having a selected mass-to-charge ratio in the ion trapping region and destabilizing trajectories of other ions that do not have the selected mass-to-charge ratio, resulting in the other ions not being trapped in the ion trapping region.

13. The process of claim 11, wherein the spherical ion trap further comprises a first ancillary compensation electrode in electrostatic communication with the ion trapping region, such that the first ancillary compensation electrode receives a first compensation DC voltage; and the process further comprises providing the first compensation DC voltage to the first ancillary compensation electrode to trap ions in the ion trapping region.

14. The process of claim 13, wherein the spherical ion trap further comprises a second ancillary compensation electrode in electrostatic communication with the ion trapping region and that receives a second compensation DC voltage;

the first ancillary compensation electrode opposes the second ancillary compensation electrode across the ion trapping region; and the process further comprises providing the second compensation DC voltage to the second ancillary compensation electrode to trap ions in the ion trapping region.

15. The process of claim 14, wherein the first ancillary compensation electrode and the second ancillary compensation electrode are disposed out of the plane in which the first RF electrode, the second RF electrode, the RF ground electrodes, and the ion trapping region are disposed.

16. The process of claim 11, wherein the spherical ion trap further comprises a plurality of in-plane compensation electrodes in electrostatic communication with the ion trapping region and that receives a compensation DC voltage; and the process further comprises providing the compensation DC voltage to the in-plane compensation electrodes to trap ions in the ion trapping region.

17. The process of claim 16, wherein the in-plane compensation electrodes are disposed in the plane in which the first RF electrode, the second RF electrode, the RF ground electrodes, and the ion trapping region are disposed.

18. The process of claim 17, wherein the in-plane compensation electrodes comprise a first in-plane compensation electrode and a second in-plane compensation electrode.

19. The process of claim 18, wherein the first in-plane compensation electrode and the second in-plane compensation electrode protrude from the substrate wall into the ion aperture toward the ion trapping region, such that the first in-plane compensation electrode is spaced apart from and opposes the second in-plane compensation electrode.

20. The process of claim 11, wherein a thickness of the first RF electrode, the second RF electrode, the RF ground electrodes, and the ion trapping region is from 50 μm to 5 mm.

* * * * *